US007878340B1

(12) United States Patent
Olsen

(10) Patent No.: US 7,878,340 B1
(45) Date of Patent: Feb. 1, 2011

(54) CUSTOM-FITTED WINE RACK SYSTEM

(76) Inventor: Kevin Raymond Olsen, 3580 Bayside Rd., Orono, MN (US) 55356

( * ) Notice: Subject to any disclaimer, the term of this patent is extended or adjusted under 35 U.S.C. 154(b) by 133 days.

(21) Appl. No.: 12/148,156

(22) Filed: Apr. 17, 2008

Related U.S. Application Data

(60) Provisional application No. 61/000,309, filed on Oct. 25, 2007.

(51) Int. Cl.
*A47B 73/00* (2006.01)

(52) U.S. Cl. ..... 211/74; 211/187; 211/75; 211/186; 211/189

(58) Field of Classification Search ..... 211/74, 211/75, 49.1, 85.22, 186, 59.2; 52/832, 834, 52/836, 241, 236.7
See application file for complete search history.

(56) References Cited

U.S. PATENT DOCUMENTS 3,606,023 A * 9/1971 Edmunds ..... 211/74
3,870,155 A * 3/1975 Galloway ..... 211/74
D273,450 S 4/1984 Williams
4,562,776 A * 1/1986 Miranda ..... 108/190
D289,716 S 5/1987 Boland, II
4,854,096 A * 8/1989 Smolik ..... 52/241
5,169,009 A 12/1992 Bomze
5,370,245 A 12/1994 Tersch et al.
5,906,080 A * 5/1999 diGirolamo et al. ..... 52/243.1
5,975,314 A * 11/1999 Lee ..... 211/13.1
D421,370 S 3/2000 Hints
6,374,558 B1 * 4/2002 Surowiecki ..... 52/241
D497,526 S 10/2004 Sanders et al.
2007/0080124 A1 4/2007 Frentzel
2008/0251478 A1 * 10/2008 Jaskowski ..... 211/74

* cited by examiner

*Primary Examiner*—Darnell M Jayne
*Assistant Examiner*—Patrick Hawn
(74) *Attorney, Agent, or Firm*—Berggren law Office, LLC; William R. Berggren

(57) ABSTRACT

A wine rack system for the easy assembly of a custom-fitted wine rack apparatus is described. The system comprises parts that enable the construction of the wine rack apparatus that is able to be easily assembled and custom-fitted into a variety of differently-sized home storage spaces and affixed to at least one storage space surface. The resulting wine rack apparatus is sturdy, flexible, modular and stationary.

10 Claims, 3 Drawing Sheets

CUSTOM-FITTED WINE RACK SYSTEM

CROSS REFERENCE TO RELATED APPLICATIONS

This application claims the benefit of PPA App. No. 61/000,309 filed 2007 Oct. 25 by the Kevin Raymond Olsen.

FIELD OF THE INVENTION

This invention relates to a wine rack and more particularly to a custom-fitable wine rack and system for assembling thereof.

BACKGROUND OF THE INVENTION

There is a need for a wine rack that can be easily assembled by a person to fit in a custom space without resorting to expensive carpentry construction or fixed-sized stand-alone racks.

Wine racks have been around for years to store wine. Typically the wine racks are custom made by carpenters to fit in storage areas suitable for storing wine bottles.

Various wine racks have been disclosed in the literature. These racks are often stand-alone constructions that provide questionable stability if used to store several cases of bottles. Some of these racks are modular in nature with many parts.

However there is still a problem of trying to store wine bottles in a storage area that would require a "custom" sized wine rack that is able to be easily assembled and affixed to at least one surface of the storage area.

SUMMARY OF THE INVENTION

I have invented a wine rack system for an easily-assembled custom-fitted wine rack apparatus. The system comprises parts that enable the construction of the wine rack apparatus that is able to be easily assembled and custom-fitted into a variety of differently-sized storage spaces and securely affixed to at least one surface of the storage space. The resulting wine rack apparatus is sturdy, flexible, modular and stationary.

The resulting wine rack apparatus of the system includes at least one wine rack row able to be in stationary communication with at least one surface of the storage space. Each row comprises four substantially vertical supports in the form of a leftward pair and a rightward pair, and two substantially horizontal supports in the form of a forward to support and a rearward support. Both the leftward and rightward pairs of vertical supports comprise a forward and a rearward support, where at least one pair is affixable to a surface of a storage space selected to store wine bottles. The forward horizontal support has an upper and lower edge, two ends, a thickness, a height, and a pre-selected length sufficient to be able to be in communication with the leftward forward and rightward forward pair of vertical supports. The upper edge has at least one curved cut-out where the cut-out is suitably sized to be able to cradle the neck portion of a wine bottle. The rearward horizontal support has an upper and lower edge, two ends, a thickness, a height, and a pre-selected length sufficient to be able to be in communication with the leftward rearward and rightward rearward pair of vertical supports. The upper edge has at least one curved cut-out where the cut-out is suitably sized to be able to cradle the body portion of various sizes of wine bottles. Wine rack rows may be positioned above and below each other, space permitting. Space separators may also be used to standardize distances between a wine rack and the floor, a wine rack and a neighboring wine rack.

I have also invented a wine rack. The resulting wine rack apparatus includes at least one wine rack row affixed to at least one surface of a storage space. Each row comprises four substantially vertical supports and two substantially horizontal supports. The vertical leftward pair of vertical supports comprises a forward and a rearward supports and a rightward pair of vertical supports comprising a forward and a rearward support, at least one pair able to be affixed to at least one surface of a storage space selected to store wine bottles. The forward horizontal support has an upper and lower edge, two ends, a thickness, a height, and a pre-selected length sufficient to be in communication with the leftward forward and rightward forward pair of substantially vertical supports. The upper edge has at least one curved cut-out where the cut-out is suitably sized to be able to cradle the neck portion of a wine bottle. The rearward horizontal support has an upper and lower edge, two ends, a thickness, a height, and a pre-selected length sufficient to be in communication with the leftward rearward and rightward rearward pair of substantially vertical supports. The upper edge has at least one curved cut-out where the cut-out is suitably sized to be able to cradle the body portion of various sizes of wine bottles. Wine rack rows may be positioned above and below each other, space permitting. Space separators may also be used to standardize distances between a wine rack and the floor, a wine rack and a neighboring wine rack.

As used herein:

"Affixed" means in stable communication by such means as, for example, adhesive, mechanical fasteners, screws, or a combination thereof, or, in the case of a vertical support affixed to ceiling and floor of a storage space, also by such means as expansion forces caused by, for example, compressed springs in communication with the vertical support, and the floor and ceiling.

"Custom-fitted" means the horizontal supports are flexible and the wine rack rows are modular such that a wine rack can be assembled to fit a specified storage space.

"Easily assembled" means that assembly could be done by a person of ordinary skills able to assemble furniture kits from large department stores such as, for example, Sears® or IKEA® without the need for professional carpentry skills.

"Flexible" means the horizontal supports can be cut to specified lengths to fit an available width of storage space so that the wine rack is able to be easily assembled in custom lengths of wine bottle supports.

"Modular" means a given wine rack row is able to be replicated, typically in vertical arrangements.

"Stationary" means that at least one pair of leftward or right ward vertical supports are affixed to at least one wall or floor and ceiling, and sometimes both pairs to opposing surfaces, of a selected storage space.

"Sturdy" means a wine rack row is able to hold up to 12 bottles without significant bending.

"Surface of a storage space" means a wall, opposing walls or a ceiling and a floor.

My invention has several advantages over existing wine racks. First it is a fixed-to-at-least one-surface rack that can be easily assembled by a person such as, for example, a homeowner. Second, it can be simply adjusted in horizontal length with a typical saw to fit desired storage spaces. Third, its modular format allows for multiple rows to be easily and sturdily assembled. Fourth, space separators provide adequate and consistent spacing between forward and rearward supports and between vertically displaced rows.

BRIEF DESCRIPTION OF THE DRAWINGS

One or more embodiments of the invention are described in the accompanying drawings. The drawings are briefly described below.

DETAILED DESCRIPTION OF SOME EMBODIMENTS OF THE INVENTION

Figure 1:
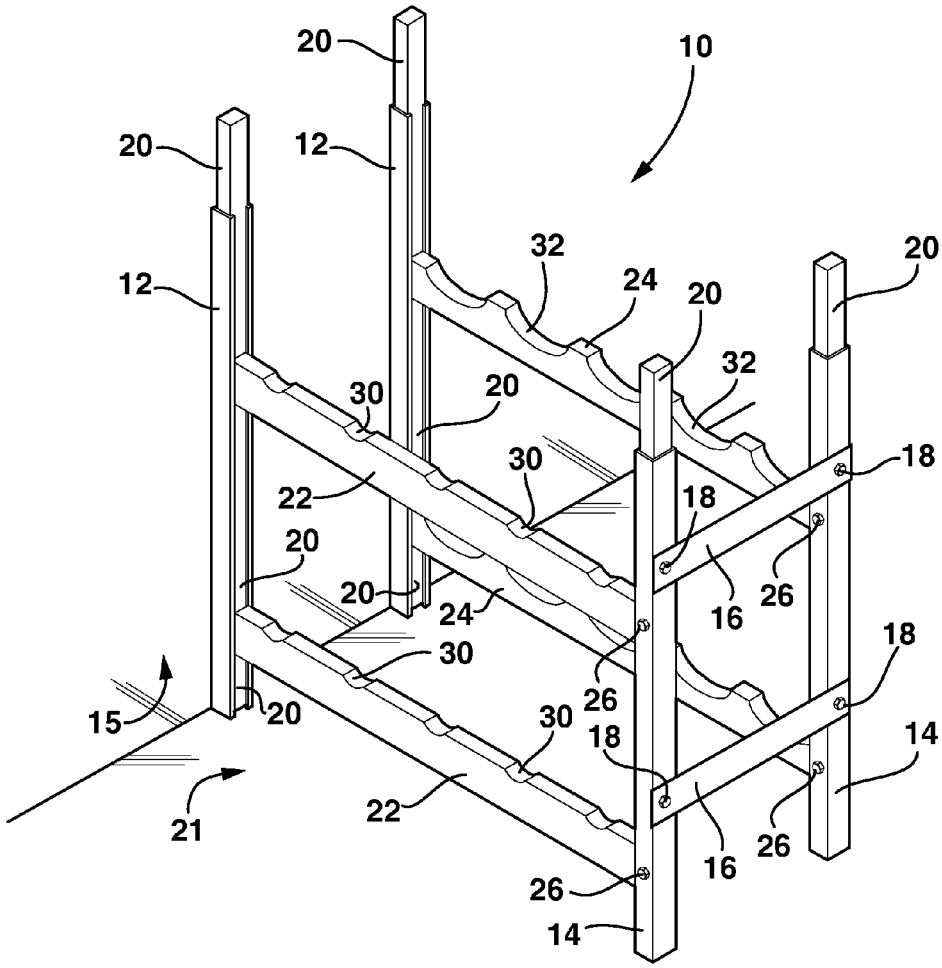
FIG. 1 is a perspective view of an embodiment of the apparatus of the invention from an upper left point of view.

My invention is a system for the assembly of a wine rack apparatus and the resulting wine rack apparatus. The system comprises parts that enable the construction of the wine rack apparatus that is able to be easily assembled and custom-fitted into a variety of differently-sized home storage spaces, and affixable to at least one surface of the space. The resulting wine rack apparatus is sturdy, flexible, modular and stationary.

Wine racks have been used for years to store bottles of wine. Most are custom constructed by those with carpentry or cabinet-making skills. Typically the wine racks are affixed to opposing walls of a storage space or in freestanding constructions resembling cabinets. Various free-standing wine rack constructions have been disclosed in the literature. These constructions seem complex, of fixed dimensions, or have questionable ability of holding cases of wine bottles in a safe and secure manner. Thus there is still a need for a wine rack apparatus that is able to be easily assembled and custom fitted into a variety of sizes of storage spaces.

The invention solves the above problem for several reasons. First, the size and shape is determined by the person assembling the apparatus, such as, for example, a homeowner. Further discussion will refer to the person that assembles the apparatus as the homeowner. However, this description is not meant to limit the assembly to homeowners or the storage spaces to homes.

Second, the system does not require special tools. Common household tools such as, for example, a saw and a screwdriver, are sufficient without the need for professional carpentry tools or equipment.

Third, the apparatus can be added to or subtracted from at will. The modular nature of each row of the wine rack permits such alterations.

Fourth, the invention is flexible rather than pre-constructed to lengths for storage. Thus it is not limited to one particular size of storage space.

The wine rack apparatus of the system includes at least one wine rack row affixable, or in stable communication with, at least one surface of a storage space. Each row includes a pair of substantially vertical supports comprised of a leftward pair and a rightward pair, a forward substantially horizontal support and a rearward substantially horizontal support. Vertical and horizontal dimensions are meant to be approximate and not precise. Because at least one side of the rack is affixed to a wall, or the floor and ceiling, of the storage space, and sometimes both sides to opposing walls, or the floor and ceiling, or a combination thereof, and because the upper edge of each horizontal support has at least one curved cut-out configured to cradle the neck and body of a wine bottle, precise dimensions are not necessary to achieve a wine rack able to hold wine bottles securely. However, sometimes storage spaces do not have surfaces that are vertical and horizontal but are off from those orientations. In that situation, levels, wedges and cut-down space separators, depending on the circumstances, may be used to obtain dimensions that are closer to a vertical and horizontal orientation as will be discussed below. Alternatively, the horizontal supports and optional vertical space separators may be trimmed to accommodate irregular storage space dimensions.

At least one of each pair of vertical space separators must be affixed to a surface of the storage space to maintain desired wine rack stability when loaded with wine bottles. That pair may be able to be affixed to a wall of the storage space or a floor and ceiling. In embodiments where the other pair is not affixed to the surface of the storage space, the free-standing forward and rearward vertical support must be connected with additional members to achieve suitable stability. Such members are well-known in the storage shelving industry and include rods or sheets of material in horizontal, angled or crisscross fashion. The vertical supports and option-al connecting members may be of any material with sufficient strength to result in a stable wine rack. Materials include, for example, metal, plastic and wood.

The vertical supports come in two pairs, a leftward pair comprising a forward and rearward support and a rightward pair comprising a forward and rearward support. In an embodiment where a pair is able to be affixed to the wall of the storage space, various means of achieving a stable communication may be used. The outer side of one pair is affixed to a wall of a storage space. The means of affixing can be any known to the industry and include, for example, adhesive, screws, and adhesive-backed mechanical to fasteners. The screws recessed and may be accompanied with spring-actuated V-forming nuts or expandable anchoring cylinders for more securely affixing screws to sheet rock panels where no studs exist. When vertical space separators are used, the primary load-bearing function is borne by the vertical line of space separators and ends of horizontal supports that is in direct contact with the floor. Then the attachment means for the vertical supports is primarily used to obtain proper alignment.

I-n an embodiment where the pair of vertical supports is able to be affixed to the floor and ceiling of the storage space, various means of achieving a stable communication may be used. Extension members are attached to the upper ends of the pair of supports to be affixed to the ceiling and floor to bridge the gap between the top of the modular vertical support and the ceiling. Various means known to the industry may be used including, for example, telescoping members pressed into the ceiling and held in place with set screws or springs. The top side of one pair is then affixed to the ceiling of a storage space and the bottom side to the floor. The means of affixing can be any known to the industry and include, for example, adhesive, screws, adhesive-backed mechanical fasteners, and the compression forces of springs. The screws may be accompanied with spring-actuated V-forming nuts or expandable anchoring cylinders for more securely affixing screws to sheet rock panels where no studs exist Like with the wall mounted supports, when vertical space separators are used, the primary load-bearing function is borne by the vertical line of space separators and ends of horizontal supports that is in direct contact with the floor. Similarly, the attachment means for the vertical supports is primarily used to obtain proper alignment.

The inner side of each vertical support has a means of being in communication to with at least one horizontal support. One embodiment of the invention had vertical supports with a length sufficient to hold one horizontal support for one row of bottles. Another embodiment has vertical supports with a length sufficient to hold more than one horizontal support for more than one row of bottles.

The communication may be by any means that permits secure support of the horizontal supports when loaded with wine bottles. One embodiment includes vertical supports with horizontal slots along at least the inner surface. Clip-on horizontal platforms similar to those used with shelving are attached to a pair of slots of each of four vertical supports in a horizontal plane suitable to provide support for the ends of the horizontal supports. However, the clip-on arrangement must be sufficiently tenacious to remain intact when in contact with a horizontal support weighted down with wine bottles. Other embodiments may have the position of each platform clip-on such as to result in a plane tilting downward as one moves from rear to forward. Vertical plates may run along the sides of the vertical supports to assist in maintaining a secure upright orientation of the horizontal supports.

Another embodiment includes vertical supports shaped with an open channel facing inward. The channel walls are constructed to achieve a compression fit of the ends of the horizontal support. Thus, the channels are made of materials that have some flexural movement to permit the entry into the channel of a slightly wider object but also are stiff enough to hold the object in place. The gripping force needed depends on whether the primary support of weight of the horizontal supports when loaded with wine bottles is (1) the communication point between the horizontal support and the channel support or (2) the vertical line of vertical space separators and ends of horizontal supports in contact with the floor of the storage space. Materials may be any that provide satisfactory functional performance and include, for example, metal, plastic and wood.

Vertical space separators typically are between floor and the bottom of the lowest horizontal support and between subsequent horizontal supports when more that one wine rack row is desired. Space separators, often precut, may be sized to fit securely within the channels or externally to the channels. Use of the space separators shifts the primary support of the weight of the bottles to the floor and not to the points where the horizontal supports communicate with the vertical supports.

The height of the vertical supports depends on a number of factors. When a vertical support are only used to support one clip-on platform and will be affixed to a storage space wall, the height can be short, as little as six (6) inches, three (3) inches or two (2) inches for various embodiments. When the support is free-standing, it may be a little as eleven (11) inches, five (5) inches or seven (7) inches for various embodiments. When the vertical support is of a channel variety, typically at least five (5) inches of free space is required above the position where the horizontal support is meant to rest to allow for the racks to be slid down the channel into place. When more than one wine rack row is desired, multiple vertical supports may be affixed to walls, stacked end on end or be fashioned in lengths long enough to permit more than one wine rack row.

The system further may include wedges to adjust the final height of space separators to achieve more horizontal orientation of the wine rack rows. Wedges may be of a variety of materials such as, for example, plastic or wood and are typically easy to break off to achieve desired thickness for preferred height adjustment. Wedges typically have height-s that progressive increase from less than one-sixteenth (1/16) inch to more than one-quarter (1/4) inch over a span of between six (6) and eight (8) inches.

Forward horizontal supports are those members that are in contact with the neck of a wine bottle. They have an upper and lower edge two ends, a thickness, a height, and a pre-selected length sufficient to be able to be in communication with the forward pair of substantially vertical supports. The desired length is achieved by cutting the support to the length available in the desired storage space. The upper edge has at least one curved cut-out where the cut-out is suitably sized to be able to cradle the neck portion of a wine bottle. Cut-outs are spaced such that the distance between the axes of neighboring cut-outs is more than the diameter of a typical wine bottle. Some embodiments have distances between the neighboring axes of cut-outs of about four inches while others have distances that are more or less.

Rearward horizontal supports are those members that are in contact with the body of a wine bottle. They have an upper and lower edge two ends, a thickness, a height, and a pre-selected length sufficient to be able to be in communication with the rearward pair of substantially vertical supports. The desired length is achieved by cutting the support to the length available in the desired storage space. The upper edge has at least one curved cut-out where the cut-out is suitably sized to be able to cradle the body portion of various sizes of wine bottles. Cut-outs are similarly spaced as in the forward horizontal support. The length of each of the forward and rearward horizontal supports is custom-altered such that each axis of a pair of forward and rearward curved cut-outs are at least approximately lined-up.

The horizontal supports are positioned so that wine bottles of varying heights may be securely stored. The curved cut-outs of each support and the positions of each horizontal support are positioned such that the vertical axis through a wine bottle when upright is approximately horizontal or angling slightly forward when the wine bottle is lying in a pair of cut-outs. In this manner, the smaller forward cut-out prevents the bottle from sliding forward off the supports. Also, the spacing between the forward and rearward horizontal supports is such that the center of gravity of a wine bottle on its side is between the two supports. Thus, the same spacing between the forward and rearward horizontal support can accommodate a variety of wine bottle sizes.

The height of the horizontal support from the bottom edge to the base of the curved cut-out is sufficiently long to permit a minimal of bending of the horizontal support when loaded with wine bottles. A minimal bend results in the support being substantially horizontal when fully loaded with wine bottles. The length varies depending on the materials used, the thickness of the support and the length of the support. Materials can be any that provide sufficient strength and ease of cutting to achieve custom lengths and include, for example, wood and plastic.

Horizontal spacers may be used to maintain different horizontal distances. Some may be used to standardize the distance between the vertical forward support and the vertical rearward support. Others may be used to standardize the distance between the rearward vertical support and a rear wall of the storage space. The space separators may be affixed to the vertical support or may be used only to determine spacing and discarded once the vertical supports are in their intended position. The forward and rearward horizontal supports should be sufficiently far apart to permit the center of gravity of the wine bottle to lie between the two supports. The rearward horizontal support should be sufficiently distanced to not have the wine bottle touching the rear storage wall.

I have also invented a custom-fitted wine rack apparatus that has been described above. Some embodiments are shown in the figures. For the sake of clarity, common elements will have similar numbers even when there actual shape is different. The embodiments are only to illustrate different aspects of the apparatus of the invention and not meant to limit the scope of that invention.

Figure 2:
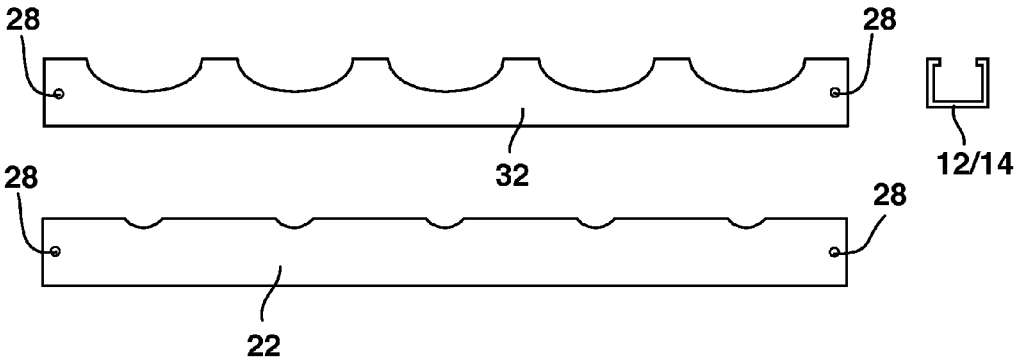
FIG. 2 is a front view of the forward and rearward horizontal supports and a top view of a channel vertical support of the embodiment of the apparatus of the invention shown in FIG. 1.

One embodiment is shown in FIGS. 1 and 2. FIG. 1 illustrates a. perspective view of the embodiment of the apparatus of the invention from an upper left point of view. Wine rack (10) comprises vertical supports that include a leftward pair (12) and a rightward pair (14) of the channel variety. As shown, leftward pair 12 is mounted to a storage space wall (15) with screws and rightward pair 14 is joined by a horizontal space fixture (16) that is positioned for each horizontal wine rack row and fastened to the pair with joining screws (18) and nuts (not shown). A horizontal space separator (not shown) may also be used to standardize horizontal separation or vertical supports within a pair. Vertical space separators (20) are placed in each channel where the vertical support touches a storage space floor (21) and to separate a subsequent wine rack row from one below it. A forward horizontal support (22) is placed in the forward vertical support of each vertical support 12, 14 on top of space separator 20. Similarly, a rearward horizontal support (24) is placed in the rearward vertical support of each vertical support 12, 14 on top of space separator 20. Stabilizing screws (26), secured with nuts (not shown), are passed through the sides adjacent to the opening of each rightward vertical support pair 14 and through stabilizing holes (28) in the end of each horizontal support placed in the channel to securely anchor the free-standing rightward support pair 14 but are not needed to support the weight of the horizontal support loaded with up to 12 wine bottles. A second horizontal space fixture 16, set of vertical space separators 20, forward horizontal support 22 and rearward horizontal support 24 are added and secured as shown in part when an additional wine rack row is desired. In such a manner, wine rack 10 may comprise as many rows as desired that are able to fit in a selected storage space.

FIG. 2 is a front view of forward and rearward horizontal supports 22, 24 and a top view of one vertical support of pair 14 of the embodiment of the apparatus of the invention shown in FIG. 1. Stabilizing hole 28 is depicted at each end of both horizontal supports to allow for the option of either side of wine rack 10 to be mounted to a wall. As illustrated, the smaller curved cut-outs (30) along the top edge of horizontal support 22 is smaller than the larger curved cut-outs (32) along the top edge of horizontal support 24 and the axis of each forward cut-out 30 and its corresponding rearward cut-out 32 is in the same vertical plane that is approximately perpendicular to the horizontal plane of the rack. Some deviation is permitted in the alignment of the axis of the smaller cut-out with the axis of the corresponding larger cut-out as long as a wine bottle is able to be securely stored. The vertical support is illustrated with joining screw 18 and stabilizing screw 26, and with nuts not shown.

When both vertical support pairs are affixed to the opposing walls of the storage space, some aspects of the embodiment change. There is no horizontal space fixture 16 mounted to rightward vertical support pair 14. Also, there is no necessity of stabilizing screws 26 that are passed through the sides of each rightward vertical support pair 14 and through holes 28 of horizontal supports 22, 24 because secure communication with the opposing walls provide sufficient stability to the wine rack when fully loaded with wine bottles. In addition, the length of the horizontal supports 22, 24 are trimmed to adjust the length to the available dimensions of the desired storage space.

Figure 3:
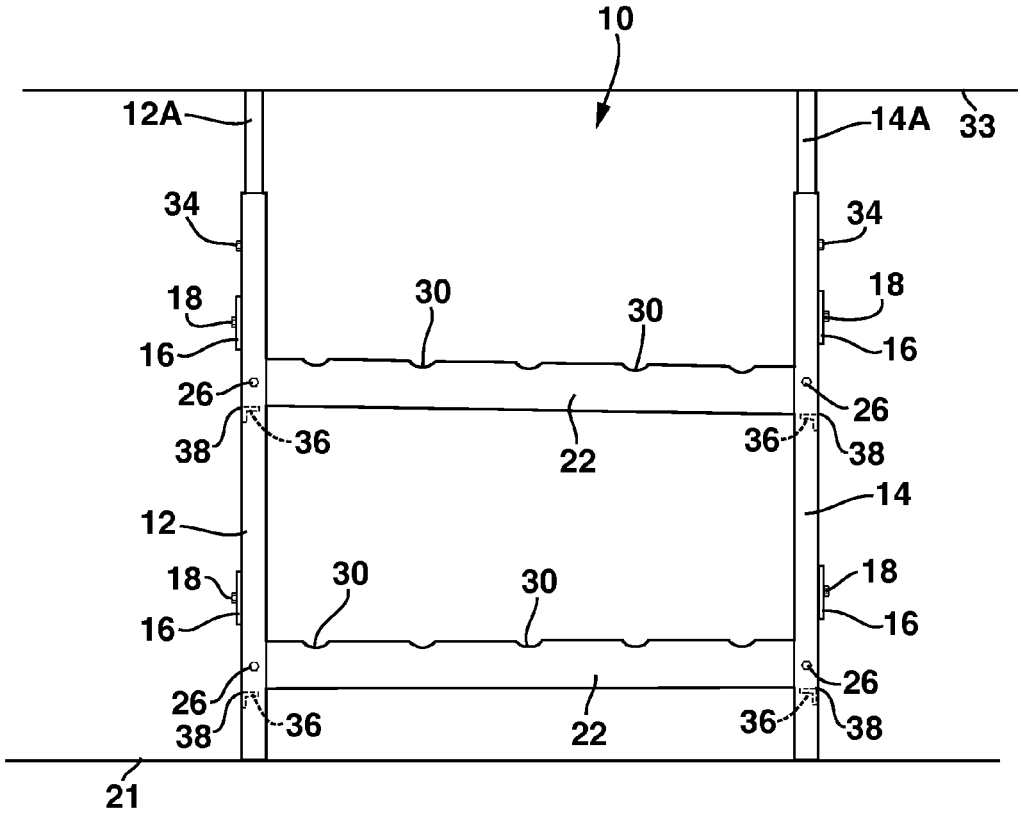
FIG. 3 is a front view of an embodiment of the apparatus of the invention
Figure 4:
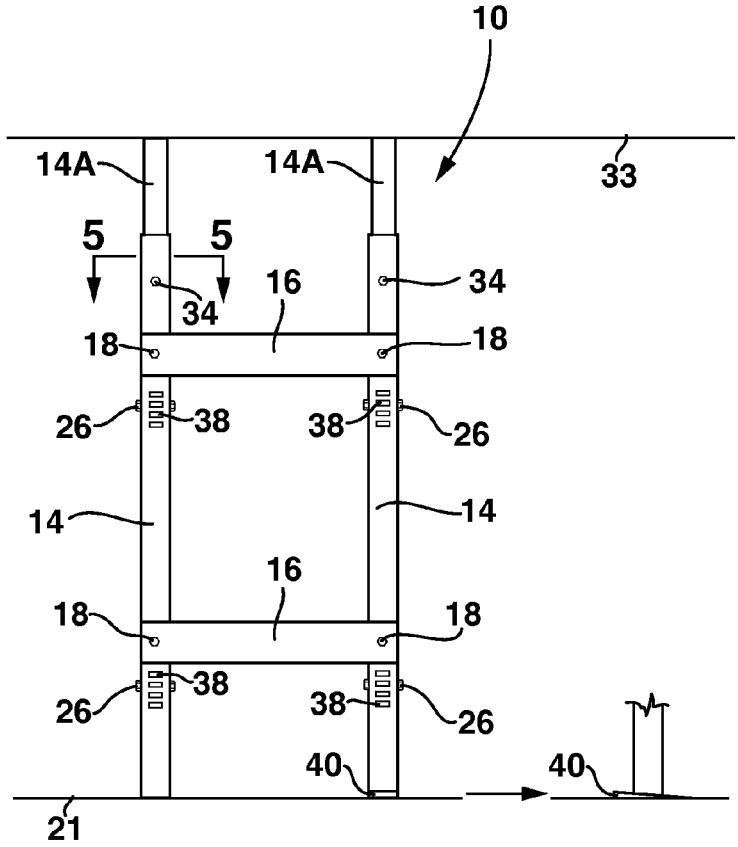
FIG. 4 is a side view of the embodiment of the apparatus of the invention shown in FIG. 3.
Figure 5:
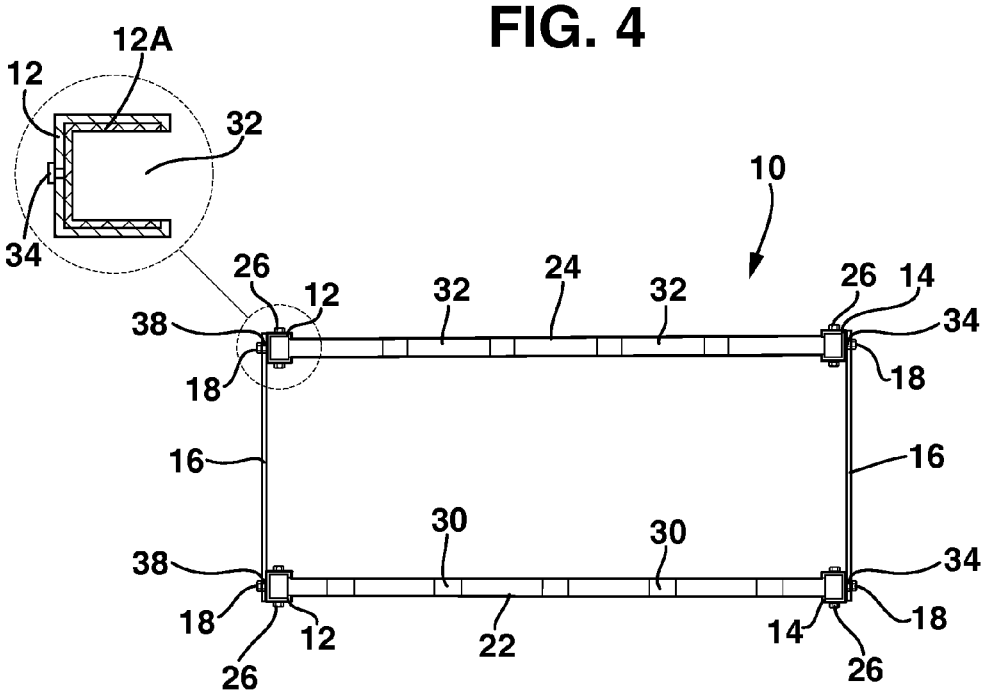
FIG. 5 is a top view of the embodiment of the apparatus of the invention shown in FIG. 3.

Another embodiment of the apparatus of the invention is shown in FIGS. 3, 4 and 5. FIGS. 3, 4 and 5 illustrate a front view, side view, and top view of an embodiment of the apparatus of the invention. This embodiment is similar to that depicted in FIGS. 1 and 2 except that both vertical support pairs 12, 14 are affixed to the floor (21) and ceiling (33) and the weight of the horizontal supports loaded with wine bottles is born by horizontal platforms clipped onto the vertical supports. As illustrated, each vertical support in leftward pair 12 and rightward pair 14 is able to telescope one length. Use of multiple telescoping supports (12A, 14A) may be used to extend the vertical support length from the floor to ceiling of a selected storage area. Alternatively the telescopic feature may be used on the top most row of the wine rack as shown in FIGS. 3, 4 and 5, to enable the vertical support to come in stable communication with the ceiling. Set screws (34) are used to fix the height of each vertical support to achieve the stable communication of the supports with the storage space surfaces. Alternatively, plates (not shown) may be affixed with such devices as, for example, set screws 34, to the top end of the vertical support to allow for some means in addition to pressure for attaching the top end of the vertical supports to the ceiling. Any suitable means of attachment may be used including, for example, screws and adhesive. Substantially horizontal platforms (36) are each clipped on to vertical support 12,14 through a pair of horizontal slots (38) to support each forward horizontal support 22 and rearward horizontal support 24. A wedge spacer (40) is used under one vertical support 14 to achieve substantially horizontal positioning of the platforms 36. Horizontal space fixtures 16 and horizontal space separators (not shown) may be used to enhance wine rack stability and uniformity. Also to enhance wine rack stability, stabilizing screws 28 may be passed through the sides adjacent to the channel opening of each rightward vertical support pair 14 and through stabilizing holes 28 in the end of each horizontal support placed in the channel. Also as illustrated in the embodiment of FIGS. 1 and 2 and depicted in FIGS. 3 and 4, the curved cut-outs 30 and the companion larger curved cur-outs 32 share the same horizontal axes.

Other embodiments include components of the embodiments already discusses. One embodiment has one pair of vertical supports affixed to a wall of the storage space and the other pair affixed to the floor and ceiling of the space. Another embodiment has one pair affixed to the floor and ceiling of a storage space and the other free-standing. Judicious use of horizontal space fixtures and stabilizing screws result in the desired stability of the various embodiments of the wine rack apparatus.

Still other embodiments of both the system and apparatus of the invention will be apparent to those skilled in the art. Some embodiments may different means for affixing the rack onto at least one surface of a storage space. Some embodiments may use different means of achieving stable communication between vertical and horizontal supports. Some embodiments may be made predominately of wood while others may be predominately of plastic. This document is meant to include all embodiments that encompass the spirit and purpose of the invention.

The invention claimed is:

1. A system for the assembly of a wine rack apparatus comprising parts for the construction of a wine rack apparatus that is capable of being configured to fit into a variety of differently-sized storage spaces each having side surfaces, a floor and ceiling surface, and a width, comprising, at least two pairs of substantially vertical supports, including a left pair and a right pair wherein at least one pair must be affixed to at least one surface of the desired storage space other than its floor and each vertical support is a compression fit channel member with the channel extending the length thereof;

at least one wine rack row comprising a pair of substantially horizontal supports including a forward support and a rearward support, capable of supporting 12 full bottles of wine having a volume of at least 750 milliliters when supported by the vertical supports at each end of each horizontal support, each horizontal support capable of being cut to achieve lengths so as to fit the available width of storage space between the pairs of vertical supports; and wherein the assembly supports each wine rack row loaded with up to 12 full bottles of wine having a volume of at least 750 milliliters, and separates a wine rack row vertically from the next nearest substantially horizontal surface whether it is the floor of the storage space or a neighboring vertically-adjacent wine rack row by a uniform distance and wherein the assembly is the combination of the compression fit channel of each of the vertical supports configured to exert sufficient compression force on the ends of the horizontal supports to enable the horizontal supports to hold up to 12 full bottles of wine having a volume of at least 750 milliliters in a stable manner and a plurality of uniform vertical spacers configured to vertically space the horizontal supports from the floor or from subsequent vertically neighboring horizontal supports, wherein the resulting apparatus is stationary, sturdy, flexible, and vertically modular.

2. The system of claim 1 wherein the left pair of vertical supports comprise forward and rearward supports and the right pair of substantially vertical supports comprise forward and rearward supports, the forward horizontal support comprises an upper and lower edge: two ends, a thickness, a height, and a chosen length configured to be in communication with the left forward and right forward pair of substantially vertical supports, where the upper edge has at least one curved cut-out and where the cut-out is sized to cradle the neck portion of a wine bottle and the rearward horizontal support comprises an upper and lower edge and two ends, a thickness, a height, and a chosen length configured to be in communication with the left rearward and right rearward pair of substantially vertical supports, where the upper edge has at least one substantially curved cut-out and where the cut-out is sized to be able to cradle the body portion of various sizes of wine bottles.

3. The system of claim 2 where the thickness of the forward and rearward horizontal supports and height between the lower edge and the bottom of the curved cut-out of each support is sufficient to keep each support substantially horizontal when loaded with 12 full wine bottles having a volume of at least 750 milliliters.

4. The system of claim 1, further comprising, wedge spacers able to adjust the heights of individual vertical space separators when floors are not horizontal so that wine racks are substantially horizontal.

5. The system of claim 1 wherein the mechanism comprises vertical space separators disposed within each vertical support channel and extending from the floor to the end of the horizontal support above the separator, where the separators are able to set the height of the bottom edge of each horizontal support to keep the horizontal row substantially horizontal.

6. The system of claim 1 where the surface is a wall.

7. The system of claim 1 where the vertical supports are affixed to opposing surfaces.

8. The system of claim 1 where the vertical supports are affixed by means of adhesive, screw-type fasteners adhesive-backed mechanical fasteners, springs in compression, or a combination thereof.

9. The system of claim 1 wherein a horizontal space separator is used to standardize the horizontal distance between the forward pair of substantially vertical supports and the rearward pair of substantially vertical supports.

10. The system of claim 1 wherein a horizontal space separator is used to maintain a minimum horizontal distance between the rearward pair of substantially vertical supports and a rear wall of the storage space.

* * * * *